US006145757A

United States Patent [19]

Knapp

[11] Patent Number: 6,145,757

[45] Date of Patent: Nov. 14, 2000

[54] SHOWER HEAD WITH SWITCHING OF SPRAY MODE

[75] Inventor: Alfons Knapp, Biberach/Riss, Germany

[73] Assignee: Masco Corporation of Indiana, Indianapolis, Ind.

[21] Appl. No.: 09/214,018

[22] PCT Filed: May 4, 1998

[86] PCT No.: PCT/US98/09110

§ 371 Date: Sep. 23, 1999

§ 102(e) Date: Sep. 23, 1999

[87] PCT Pub. No.: WO98/50113

PCT Pub. Date: Nov. 12, 1998

[30] Foreign Application Priority Data

May 5, 1997 [IT] Italy ..... TO97A0381

[51] Int. Cl.[7] ..... A62C 31/00

[52] U.S. Cl. ..... 239/443; 239/530; 239/583

[58] Field of Search ..... 239/436, 437, 239/438, 444, 445, 446, 447, 449, 525, 530, 577, 583; 137/627, 627.5, 862, 867

[56] References Cited

U.S. PATENT DOCUMENTS

| | | | |
|---|---|---|---|
| 1,647,983 | 11/1927 | Bloch | 137/867 |
| 3,637,143 | 1/1972 | Shames et al. | 239/577 |
| 4,629,124 | 12/1986 | Gruber | 239/448 |
| 4,703,893 | 11/1987 | Gruber | 239/449 |
| 5,467,927 | 11/1995 | Lee | 239/447 |
| 5,615,837 | 4/1997 | Roman | 239/530 |
| 5,730,362 | 3/1998 | Cordes | 239/447 |

*Primary Examiner*—Andres Kashnikow
*Assistant Examiner*—Lisa Ann Douglas
*Attorney, Agent, or Firm*—Kwadjo Adusei-Poku; Lloyd D. Doigan

[57] ABSTRACT

A shower head with water supplied through a flexible hose. The shower head provides for two different modes of spray that can be switched by operating two push buttons. The shower head comprises a delimited supply space, two delivery members, two distinct communication passages between the supply space and the delivery members, and two separate intercept valves, each valve controlling the flow through one of the communication passages. Each valve is connected to an operating push button. A valve lever connects the two valves, so that, as one valve is depressed and therefore closed, the other valve is correspondingly opened.

12 Claims, 4 Drawing Sheets

SHOWER HEAD WITH SWITCHING OF SPRAY MODE

FIELD OF THE INVENTION

This invention relates to a shower head with water supplied through a flexible hose. The shower head provides two different modes of spray that can be switched by operating two push buttons.

BACKGROUND OF THE INVENTION

Shower heads of the kind indicated are known; they are equipped with two push buttons by means of which the user can made a selection among two different spray modes: either a sprinkle jet provided through a plurality of holes or supply ducts or a subdivided or aerated jet provided by means of a jet breaker or a jet aerator. In the conventional forms, this switching action is achieved by means of a piston deviation valve with two positions, which can be moved into one of the two positions by pushing a push button that is directly connected to it and it can be moved into the other position by means of a valve lever. These shower heads work in an unexceptional manner, but the mechanism with which they are equipped has considerable height which does not permit the construction of shower heads with reduced height, such as are required by technological demands and current aesthetic requirements. Furthermore, the required ducts have a complex shape and are therefore difficult to make. Moreover, the operations involved in the assembly and disassembly of these shower heads are relatively complicated and, hence, assembly cannot practically be automated during the production phase. The shape of these shower heads is determined by the structure of their mechanisms so that only slight leeway is left to anyone who designs their outer configuration, especially for aesthetic purposes.

In view of the above, a first object of this invention is to provide shower heads which can be made in shapes with reduced height.

Another object of the invention is to provide shower heads in which the assembly and disassembly operations are considerably simplified.

Yet another object of the invention is to provide shower heads where the operating parts are capable of receiving exterior restraining elements that can be designed with a great degree of leeway.

Finally, another object of the invention is to provide shower heads whose industrial production will be relatively economical.

SUMMARY OF THE INVENTION

According to the invention, these objects are attained primarily by virtue of the fact that the shower head has a delimited supply space, two delivery members of different type, two pertinent communication passages between said supply space and the two delivery members, two separate intercept valves arranged so as to control each one of the two communication passages, each valve being connected to an operating push button, and a valve lever connected to said two valves in order to link them so as to perform displacements in the opposite direction.

Due to these features, when one of the operating push buttons is pressed to open or close one of the valves, and hence to supply or close off one of the two delivery members, the valve lever causes a shift in the direction opposite to the other valve, and hence the closing off or supply of the other delivery member thus achieving an overall effect corresponding to the effect that is known in connection with a deviation valve. The height dimension of this device is determined only by the height of the delivery members and by the height of a single intercept valve with its own push button. This is why the height can be kept within very small limits and thus reduced to a minimum.

Preferably, each intercept valve is a piston valve whose upper end constitutes the pertinent operating push button. This makes it possible to reduce to an absolute minimum the height dimension of the assembly made up of the intercept valves and the pertinent operating push buttons.

Preferably, the supply space is delimited by an upper support member through which extend operating push buttons and by a lower support member, displaying the closing seats for said intercept valves and supporting said delivery members. The valve lever is pivoted in between said upper and lower members, while its opposite ends are engaged in recesses formed by said intercept valves. These features make it possible to simplify the structure of the operating parts and to facilitate their assembly and disassembly.

In one embodiment the valve lever is a member having convex upper and lower surfaces arranged so as to roll against said upper and lower support members. Such a valve lever can advantageously be made of plastic material.

In another embodiment the valve lever consists of a first metallic element, preferably with a circular cross-section, and a second metallic element, preferably with a circular cross-section that is mounted on said lower support member and that extends in a direction that is orthogonal to the direction in which said first element of the valve lever extends to constitute the support and pivot of the first element.

Preferably one of the delivery members consists of a hollow member whose lower surface, looking at it peripherally, has a plurality of sprinkle delivery holes and a seat for a means for attachment to the other parts of the device and which has a central seat to receive a jet breaker or a jet aerator.

Advantageously, this means of attachment can be a screw that will connect said sprinkle delivery member and said upper and lower support members. This single screw thus serves to hold the entire device together.

In other embodiments, said means of attachment can be a screw that links said sprinkle delivery member and said lower support member, while the upper support member is separately connected to the lower support member, for example, by means of hooking of undercuts.

Advantageously, said operating push buttons are covered on top, individually or collectively, by a cover consisting of deformable material such as an elastomer.

Preferably, the operating parts of said shower head are enclosed in an external shell, which is curved or straight, and which is to a great extent spaced away from the operating parts and functions not only to determine the aesthetic appearance of the shower head but also as a heat insulation member.

To serve for the supply of shower heads having a shell with a different shape, one can provide a supply connection having at least one inclined end, which can be mounted in two positions that are rotated by 180° according to the characteristics of the shell.

DETAILED DESCRIPTION OF THE PREFERRED EMBODIMENTS

Figure 1:
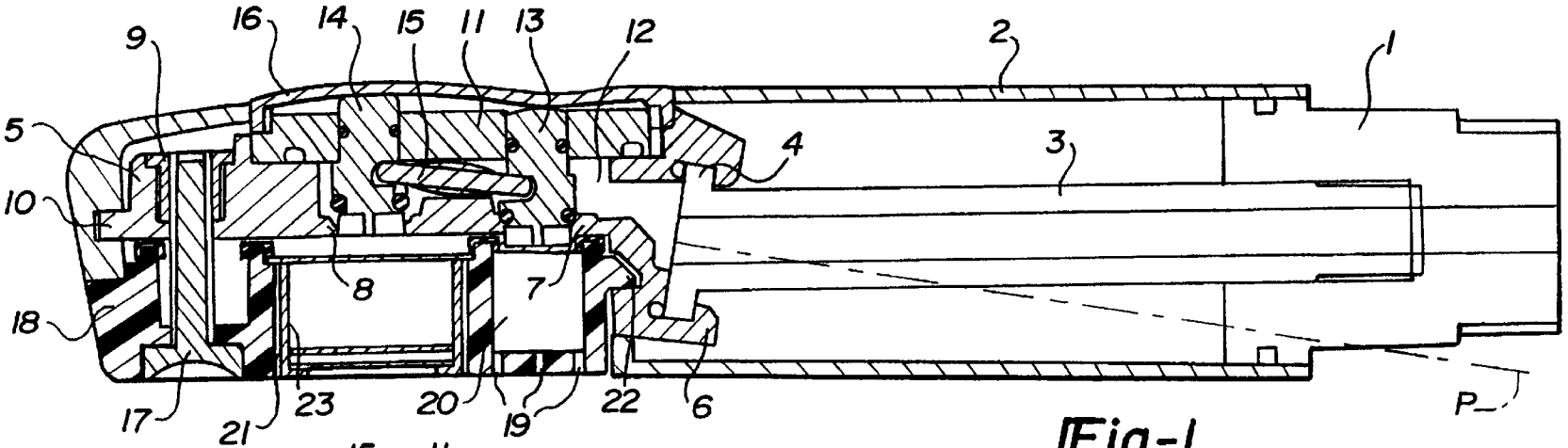
FIG. 1 is a side elevational view, in section, of a shower head according to a first embodiment of the invention having a straight external shell.

With reference to FIG. 1, a shower head of the instant invention comprises a fastening device 1, for example, a screw for the purpose of connecting a conventional flexible supply hose (not illustrated). Attachment device 1 supports the proximal portion of an external shell 2, generally tubular, which in this particular embodiment, is straight and which encloses all of the operating parts of the shower head. these operating parts are contained in the distal portion of shell 2 and are hydraulically connected to attachment device 1 by means of a connecting member 3, one of whose end flanges 4 is connected to the operating parts of the shower head by means of an undercut snap connection.

The operating parts of the shower head comprise a lower support member 5 which has means 6 for the connection of connecting member 3, two closing seats 7 and 8 for two intercept valves equipped with pistons, and means 9 for the connection of the delivery members. Preferably, the lower support member 5 also has an end tooth 10 that is hooked to a corresponding recess of shell 2 in order to integrate these parts with each other.

Superposed upon lower support member 5 is an upper support member 11 which, together with lower support member 5, delimits a supply space 12 that, through connecting member 3, communicates with attachment device 1 of the shower head. Upper support member 11 is attached to lower support member 5 by means of an elastic undercut snap, and it constitutes the support and guide for the two piston intercept valves 13 and 14 whose lower ends cooperate with the seats of valve 7 and 8, while their upper ends constitute the operating push buttons. Advantageously, the two operating push buttons are both covered by a flexible cover 16 made of, for example, an elastomeric material inserted in a corresponding window of shell 2.

A valve lever 15 is mounted between lower support member 5 and upper support member 11, and its ends are engaged in recesses formed in piston valves 13 and 14. In this embodiment, valve lever 15 has a substantially flat shape with a convex and arched lower surface that can roll into contact with the lower support member 5 thus, within certain limits, permitting the oscillation of valve lever 15 around its own central axis. In this way, piston valves 13 and 14 are linked so as to perform displacements in the opposite direction.

Attached to the lower support member 5 by means of a screw 17 is a first delivery member 18 consisting of a hollow member that peripherally has a seat for the head of attachment screw 17 and a series of holes 19 suitable for delivering a sprinkle jet. Holes 19 communicate with internal chamber 20 which, in turn, a communicates with the seat of valve 7.

First delivery member 18 has a central chamber 21 that communicates with the seat of valve 8 and that is adapted to receive a second delivery member 23 consisting of a jet breaker or a jet aerator. Preferably, from the part opposite to attachment screw 17, the first delivery member 18 also has a tooth 22 that can be engaged in a corresponding recess in lower support member 5 to stabilize the attachment of the first delivery member 18.

Suitable conventional packings, which are not described in detail, are arranged at suitable points between the parts that were described to ensure their hydraulic seal.

The shower head works in the following manner. Through flexible cover 16 pressing on the push button made up the upper end of valve 13, the seat of valve 7 is occluded, while at the same time valve lever 15 forces valve 14 to move away from valve seat 8 leaving it clear. This is the condition shown in FIG. 1. In this condition water coming from the flexible supply hose through attachment 1 and connecting member 3 passes from supply space 12 through valve seat 8, open in chamber 21, and from there exits through the jet breaker or jet aerator 23. Valve seat 7, which is closed, does not permit the supply of chamber 20 and of holes 19. A subdivided or aerated water jet is thus delivered.

By pressing through flexible cover 16 upon the push button made up of the upper end of valve 14, the seat of valve 8 is occluded while at the same time valve lever 15 forces valve 13 to move away from valve seat 7, leaving it clear. This is the condition that is opposite to the one shown in FIG. 1. In this condition, water coming from the flexible supply hose through attachment 1 and connecting member 3 passes from supply space 12 through the seat of valve 7, open in chamber 20, and from there exits through the delivery holes 19, while valve seat 8, which is closed, does not permit the supply of chamber 21 and of jet breaker or aerator 23. A sprinkle jet is thus delivered.

Figure 2:
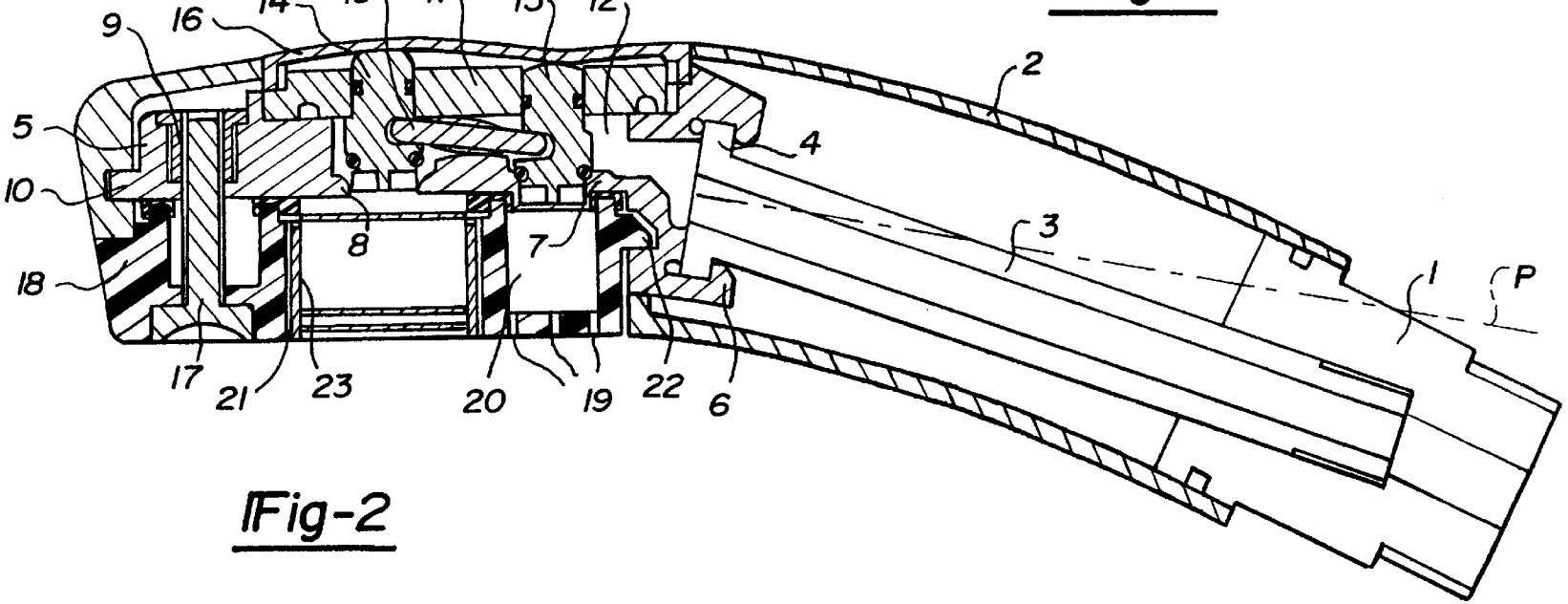
FIG. 2 is a view similar to FIG. 1 and illustrates a variant of the first embodiment where the external shell is curved.

FIG. 2 illustrates a variant of the embodiment illustrated in FIG. 1, the only difference being that the external shell 2 is curved instead of being substantially straight. In this case to connect attachment 1 to supply space 12 it is necessary for connecting member 3 to be inclined. FIGS. 1 and 2 show how, in both cases, one and the same connecting member 3 can be used. connecting member 3 has an inclined end flange 4 and the perpendicular P to the plane of flange 4 with the axis of connecting member 3 forms an angle equal to half of the inclination angle required for connecting member 3 in the case of a curved shell such as shown in FIG. 2. Connecting member 3 can be linked to lower support member 5 in two positions, rotated by 180°. In one of these positions (FIG. 1), connecting member 3 is coaxial with straight shell 2 and with attachment 1, while in the other position (FIG. 2), connecting member 3 has been shifted with respect to the previously considered position by an angle that is double the angle of inclination of flange 4, in other words, by the angle encountered in the case of curved shell 2 of FIG. 2. In this way, one can achieve an advantageous design merger between shower heads that have a widely different external configuration.

Figure 3:
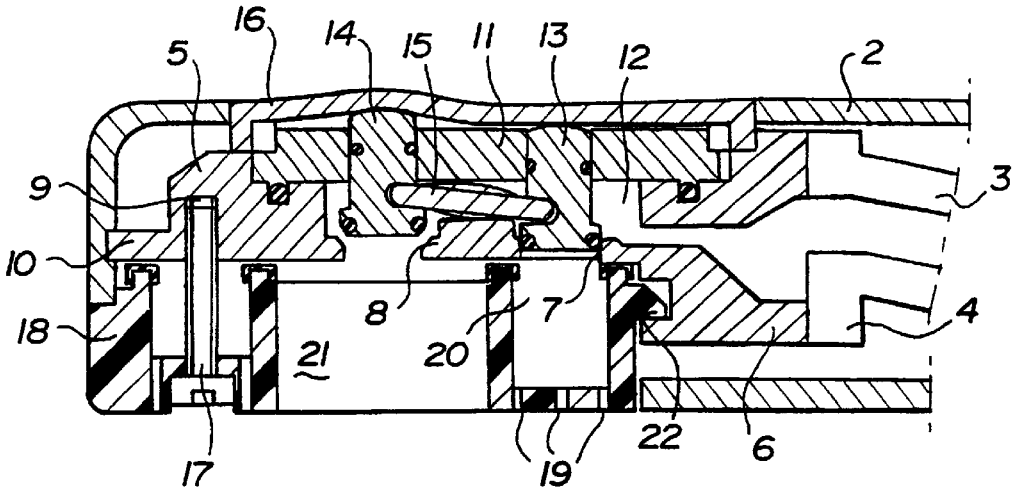
FIG. 3 illustrates another variant of the first embodiment showing the distal end of the shower head containing the operating parts.

The variant of the embodiment shown in FIG. 1 illustrated in FIG. 3 differs, other than by the design details, only by the manner in which flange 4 of connecting member 3 is linked to lower support member 5. It is understood that this connection can be accomplished in any fashion, either by means of elastic undercut snap or, for example, by means of screws or by gluing or welding. With reference to the following figures it will now be explained how the entire device can be easily broken down into its component parts and how it can easily be assembled in the production phase.

Figure 4:
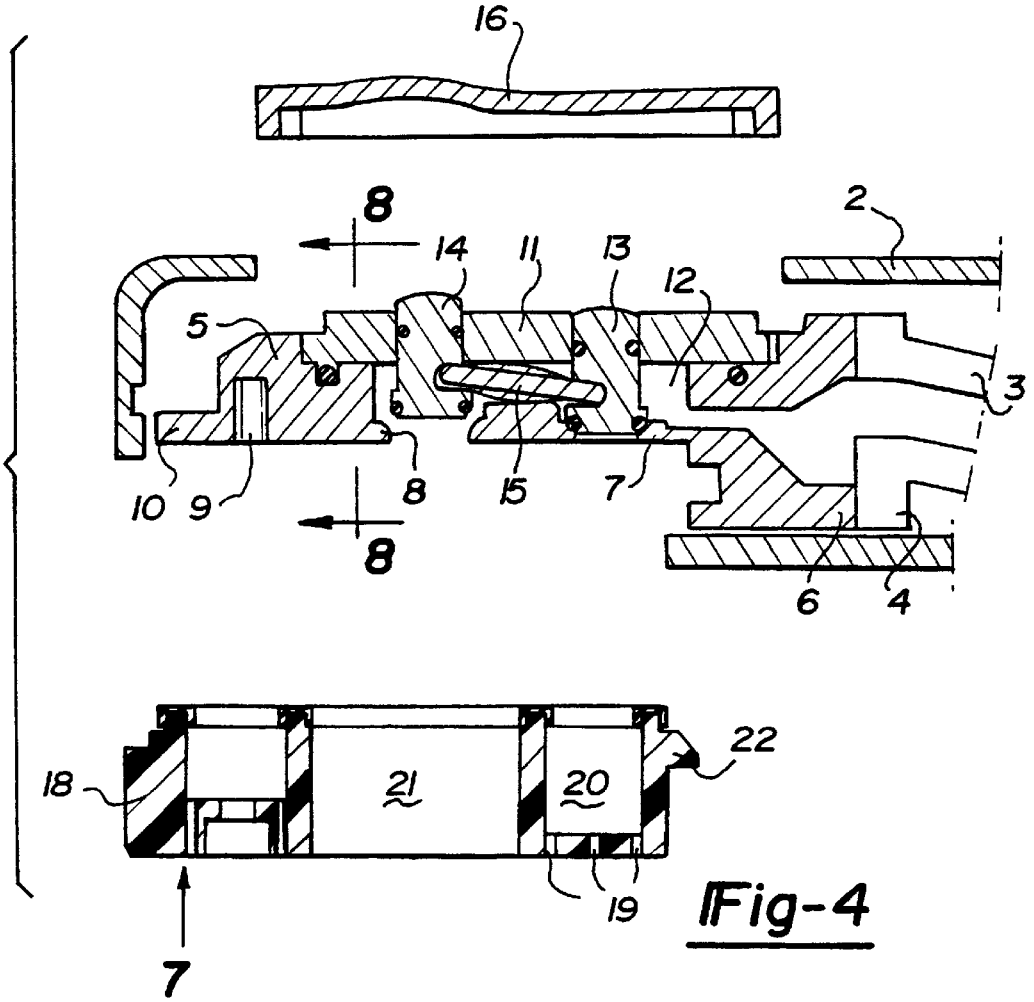
FIG. 4 is a partially exploded view of the shower head illustrated in FIG. 3.
Figure 5:
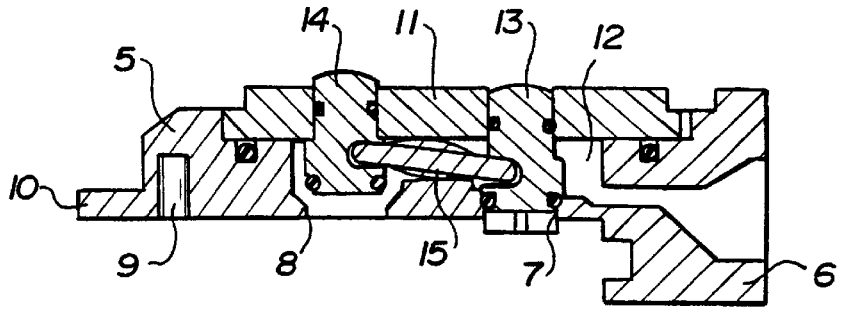
FIG. 5 is a side elevational view of the block comprising the intercept valves constituting one of the components shown in FIG. 4.

As shown in FIG. 4 flexible cover 16 can be removed from the corresponding window of shell 2 and, by unscrewing screw 17, the first delivery member 18 can be detached from lower support member 5. To the latter there is also linked upper support member 11 with the entire system of valves. It is clear that at this point the group made up of the lower support member 5 and the upper support member 11 can be unthreaded from body 2 and can be detached from connecting member 3. This group is illustrated by itself in FIG. 5.

Figure 6:
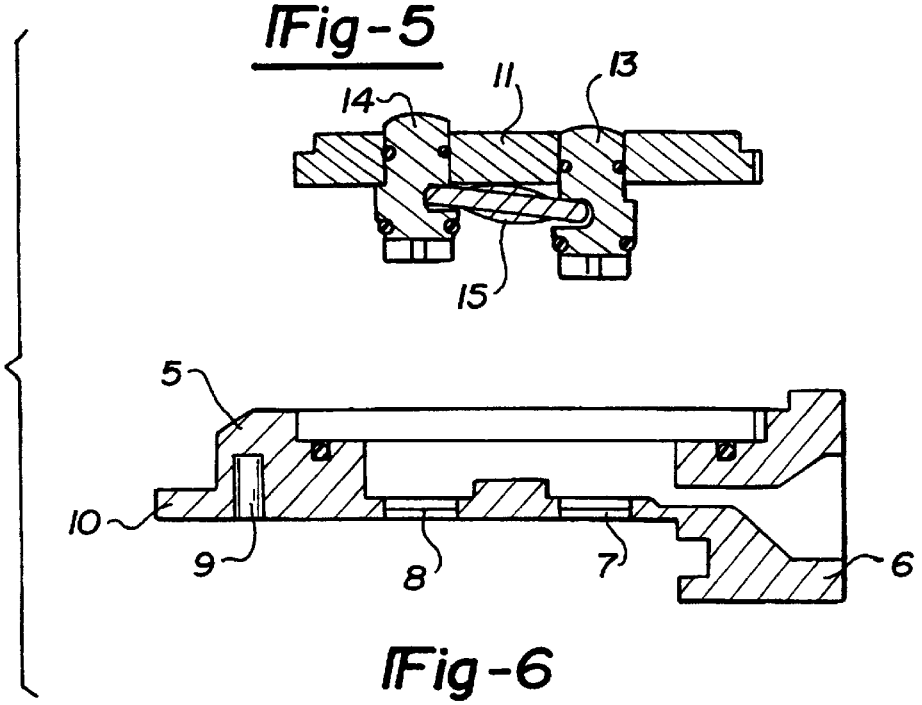
FIG. 6 is a side elevational view of the block of valves of FIG. 5 in a disassembled state.
Figure 8:
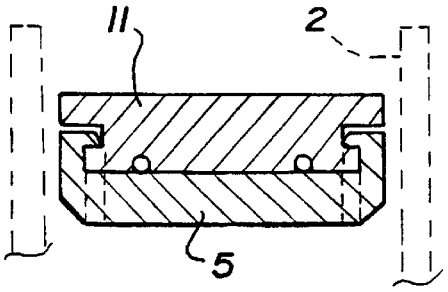
FIG. 8 illustrates a profile taken along line VIII—VIII in FIG. 4.

Upper support member 11 can now be detached from lower support member 5, as shown in FIG. 6, thus making it possible to release valves 13 and 14 and valve lever 15. The connection between support member 5 and support member 11, for example, can be accomplished by means of elastic undercut snap, as shown in FIG. 8.

It can thus be understood that the industrial assembly of the shower head has been made simple. This assembly can easily be automated and disassembly is facilitated, for example, for purposes of inspection.

Figure 7:
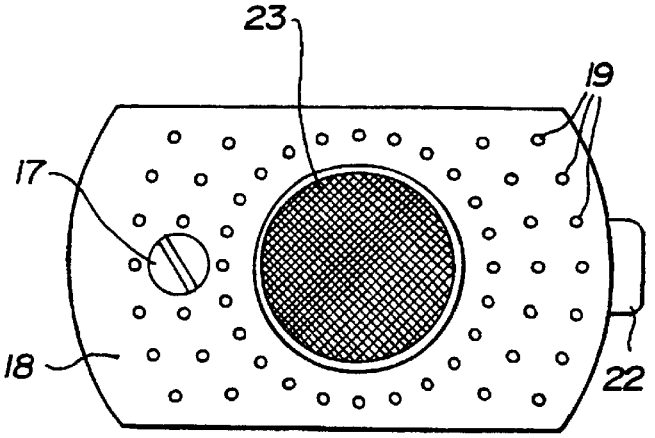
FIG. 7 illustrates the delivery member of the shower head taken along line VII in FIG. 4.

FIG. 7 illustrates the delivery members, viewed from the upper part of the surface from which the jets are delivered. This view also applies to the embodiments illustrated in FIGS. 1, 2 and 9.

Figure 9:
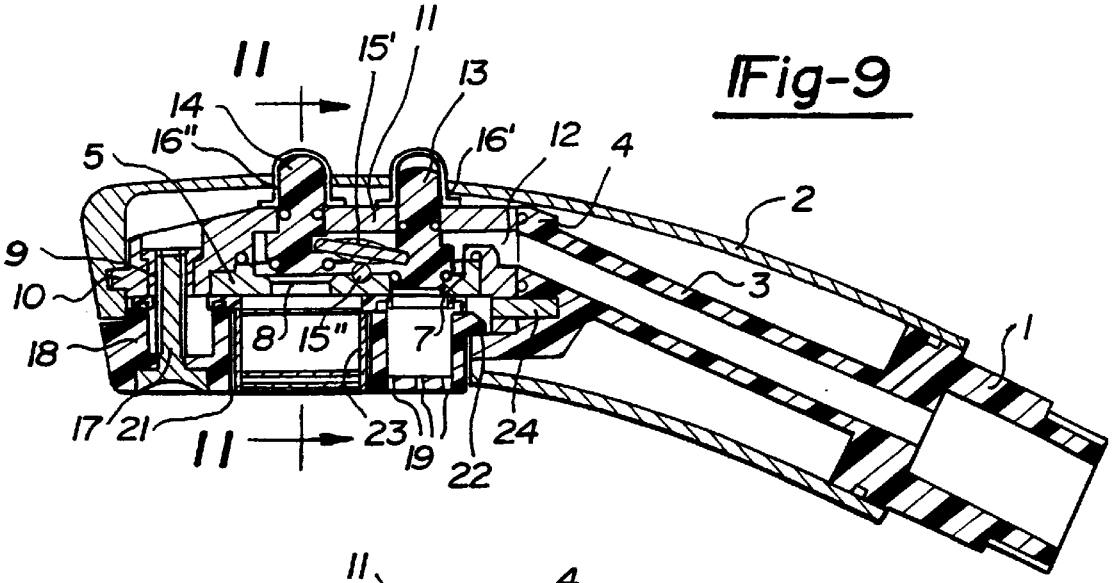
FIG. 9 is a side elevational view in section of a second embodiment of the invention.

The embodiment illustrated in FIG. 9 differs from the previous ones primarily by virtue of the fact that the push buttons, made up of the upper ends of piston valves 13 and 14, protrude on top from shell 2. In this case, each can receive an individual cover made of elastomeric material 16' and 16". However, this cover is not indispensable and can be omitted.

Figure 10:
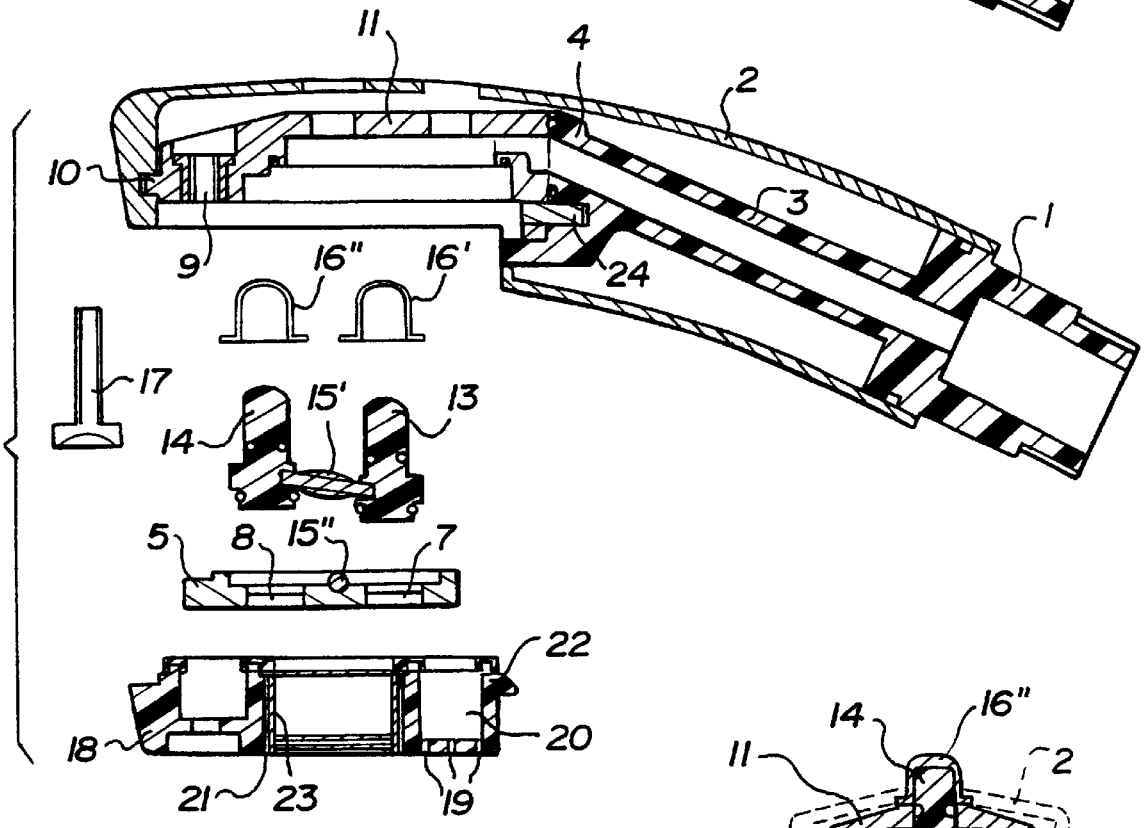
FIG. 10 is an eploded view of the shower head of FIG. 9.
Figure 11:
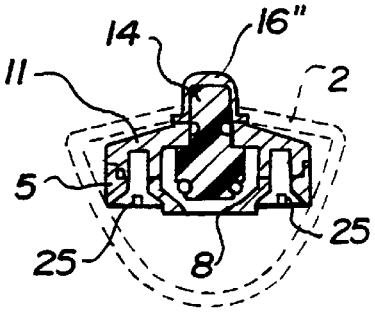
FIG. 11 is a view taken along line XI—XI of FIG. 9.

It is clear that in such an embodiment, dismantling must start from the lower part, as illustrated in FIG. 10, to permit the unthreading of shell 2. In this case, there is connected to flange 4 of connecting member 3 the upper support member 11 rather than lower support member 5. The connection is accomplished in this case with the help of a pin 24 and tooth 10 for engagement with shell 2 is presented by upper support member 11. Furthermore, screw 17 attaches first delivery member 18 to upper support member 11 including, among these parts, the lower support member 5 so that screw 17 can be used to put the entire device together. Nonetheless, one can advantageously assemble the lower support member 5 and upper support member 11 by means of screws 25, as shown in FIG. 11, or by means of snap to form a unit comprising the valves which can thus be preassembled.

FIGS. 9 and 10 show that valve lever 15 can be made up of two parts, a lever 15' that can consist of a metallic reinforcing rod, engaged in recesses presented by piston valves 13 and 14, and a pivot 15", which can also consist of a metallic reinforcing rod mounted in lower support member 5 along a direction that will be orthogorfiyl with respect to the direction of lever 15'.

It is understood that the invention is not confined to the embodiments described and illustrated as examples. Similar modifications are within the reach of the technician familiar with this art. For example, although shell 2 may be useful both for aesthetic reasons and for thermally insulating the internal parts that are subject to contact with hot water, it can in certain embodiments be omitted and can be replaced by suitable configurations of attachment 1, of connecting member 3 and of support members 5 and 11. Furthermore, the delivery members can be connected to the remaining device in ways different from those described.

These and other modifications can be made without deviating from the scope of the invention.

I claim:

1. Shower head, supplied through a flexible hose that can provide two different spray modes that can be switched by operating two push buttons comprising a delimited supply space, two supply members of different type, two pertinent communication passages between said supply space and the two supply members, two separate intercept valves so arranged as to control each one of the two communication passages, each valve being connected to an operating push button, and a valve lever that is connected to the two valves in order to link them for the performance of displacements in the opposite direction.

2. Shower head according to claim 1 wherein each of said intercept valves is a piston valve whose upper end comprises the pertinent operating push button.

3. The shower head according to claim 1 wherein said supply space is delimited by an upper support member through which extend operating push buttons and by a lower support member, the lower support member displaying the closing seats for said intercept valves and supporting a plurality of delivery members, and said valve lever is pivoted on said lower support member, while its opposite ends are engaged in recesses displayed by said intercept valves.

4. Shower head according to claim 3 wherein said valve lever is a member having convex upper and lower surfaces, so arranged as to roll against said lower support member, said valve lever comprised of plastic material or metal.

5. The shower head according to claim 3 wherein said valve lever is comprised of a first metallic element, with a circular cross-section, and a second metallic element, with a circular cross-section, which is mounted on said lower support member which extends in a direction that is orthogonal to the direction in which said first element of the valve lever extends to comprise a support and pivot of the first metallic element.

6. The shower head according to claim 3 wherein one of said delivery members is a sprinkle delivery member, comprising:

a hollow member whose lower surface, peripherally, has a plurality of sprinkle delivery holes;

a seat for a means of attachment to the other parts of the shower head; and a centrally-located seat to receive a jet breaker or a jet aerator.

7. Shower head according to claim 6 wherein said means of attachment is a screw that links said sprinkle delivery member and said upper and lower support members.

8. Shower head according to claim 6 wherein said means of attachment is a screw that connects said sprinkle delivery member and said lower support member, while the upper support member is separately linked to the lower support member by means of undercut snap or by means of screws.

9. The shower head according to claim 1 wherein said operating push buttons are covered on top, individually or collectively, by a cover made up of a deformable material.

10. The shower head according to claim 1 wherein the pushbuttons, the supply members and the intercept valves of said shower head are enclosed in an external straight or curved shell, the external shell serving both to determine the aesthetic appearance of the shower head and to act as a heat insulation member.

11. Shower head according to claim 10 wherein a supply connection has at least one inclined end, which can be mounted in two positions, rotated relatively by 180°.

12. The shower head as described in claim 9 wherein the deformable material is an elastomer.

* * * * *